United States Patent [19]

Magon

[11] Patent Number: 4,960,275

[45] Date of Patent: Oct. 2, 1990

[54] WATER IMMERSION AMUSEMENT APPARATUS

[76] Inventor: Imrych Magon, 1906 Mariposa Ave., Los Angeles, Calif. 90027

[21] Appl. No.: 432,616

[22] Filed: Nov. 6, 1989

[51] Int. Cl.[5] ..... A63G 3/00

[52] U.S. Cl. ..... 272/32; 272/38

[58] Field of Search ..... 272/1 B, 32, 38, 39

[56] References Cited

U.S. PATENT DOCUMENTS

| | | | |
|---|---|---|---|
| 848,061 | 3/1907 | Smith | 272/32 |
| 953,266 | 3/1910 | Healy | 272/32 |
| 989,280 | 4/1911 | Palmer | 272/32 |
| 1,956,151 | 10/1915 | Kohler | 272/32 |

FOREIGN PATENT DOCUMENTS

| | | | |
|---|---|---|---|
| 806341 | 6/1951 | Fed. Rep. of Germany | 272/32 |

*Primary Examiner*—Richard E. Chilcot, Jr.
*Attorney, Agent, or Firm*—Erik M. Arnhem

[57] ABSTRACT

A water immersion apparatus that includes a ferris wheel having passenger compartments arranged to descend into a pool of water and then lift out of the water. Each passenger compartment is constructed so that water is allowed to enter into the compartment. Persons within the compartment experience the effect of being directly immersed in a fast-moving stream of water.

11 Claims, 2 Drawing Sheets

WATER IMMERSION AMUSEMENT APPARATUS

BACKGROUND AND SUMMARY OF THE INVENTION invention relates to a water immersion amusement a wherein passenger compartment units are moved into and through a body of water so that people in the passenger compartments come in direct contact with the water. The walls of the passenger compartment units have flow passages (openings) therethrough, such that water partially floods the compartment interior space. People in the compartments experience the sensation of being in a fast-moving stream of water.

The amusement apparatus comprises a ferris wheel mechanism extending into a body of water so that passenger compartment units attached thereto move into and out of the water. The ferris wheel mechanism moves each compartment unit a short distance through the water, and then lifts each compartment unit up out of the water. Depending on the rotational velocity of the ferris wheel mechanism, each person is in contact with the water for two or three seconds up to about ten seconds for each revolution of the ferris wheel.

The apparatus of this invention is somewhat similar to apparatus shown in U.S. Pat. No. 953,266 issued to H. Healy, and U.S. Pat. No. 989,280 issued to M. Palmer. The present apparatus is, however, somewhat more compact and lower in cost than the apparatus shown in those patents. Additionally, the present apparatus includes a feature whereby water is caused to flow through passenger compartments in which persons are riding, thereby enabling the persons to experience direct contact with the flowing water. This feature is not achieved with the apparatus of the referenced patents.

THE DRAWINGS

DESCRIPTION OF A PREFERRED EMBODIMENT OF THE INVENTION

Figure 1:
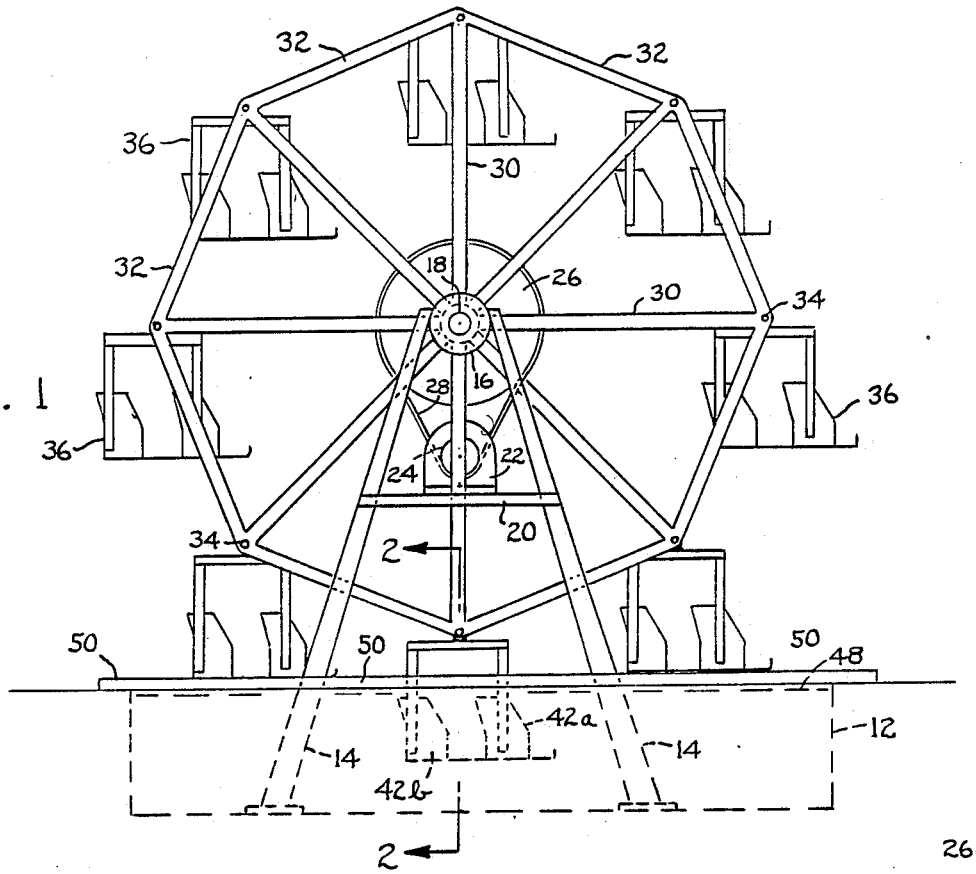
FIG. 1 is a side elevational view of an apparatus embodying the invention.
Figure 3:
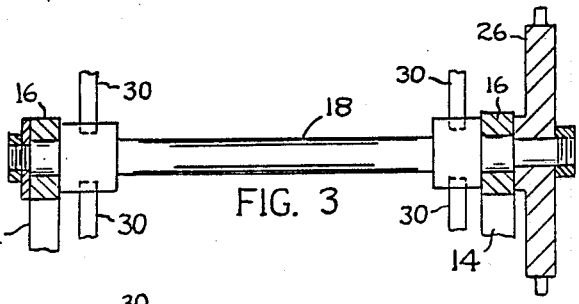
FIG. 3 is a fragmentary view taken in the same direction as FIG. 2, but along a line through an axle for the ferris wheel that forms part of the FIG. 1 apparatus.

FIGS. 1 through 4 illustrate a water immersion apparatus constructed according to the invention. The apparatus comprises . a ferris wheel structure 10 arranged so that during rotation of the ferris wheel individual passenger compartments 36 pass into and through water contained in tank 12. If the ferris wheel structure is supported on the floor of the ocean, or a lake or a stream, it is not necessary to provide tank structure 12; the naturally-occurring water at the site can be used.

The illustrated ferris wheel 10 includes two upstanding pedestals 14 having upper ends thereof connected to hub structures 16. A rotary axle 18 extends through the hub structures. Each illustrated pedestal comprises two elongated frame elements that converge toward each other in an A configuration, as shown in FIG. 1. A cross piece 20 interconnects that two frame elements some distance below hub structure 16. One of the cross pieces can be used to indirectly support an electric motor 22 that drives a small sprocket 24. Another larger sprocket 26 is affixed to shaft 18. Rotary power is transmitted from sprocket 24 to sprocket 26 via a chain 28.

Radial spokes 30 extend outwardly from shaft 18 to connect with chord-like connector struts 32. As shown in FIG. 1, there are eight sets of spokes 30; each spoke set comprises two axially-spaced spokes attached to shaft 18 inboard from pedestals 14. A shaft 34 extends between the outer ends of each spoke set to form a swingable suspension means for a passenger compartment unit 36. As shown in FIG. 1, there are eight passenger compartment units 36.

Each passenger compartment unit 36 comprises a sleeve 38 encircling a shaft 34, and two horizontal bars 40 extending crosswise of the sleeve. Four vertical bars 41 extend downwardly from the front and rear ends of bars 40 to form a support framework for front and rear seat members 42 and **42*b*. The terms "front" and "rear" are here used with reference to the direction of motion of the compartment unit as it traverses water tank 12. As seen in FIG. 1, the ferris wheel rotates in a counterclockwise direction; each passenger compartment unit 36 moves in a left-to-right direction through tank 12, such that seat member 42*a* is considered the front seat, and seat member 42*b*** is considered the rear seat.

Each seat member **42*a* or 42*b* is of conventional design, in that it includes a horizontal seat wall (surface) 43, an upstanding back rest 44, and a horizontal floor 45. Each seat member is wide enough to support two people in seated positions, side by side. An important feature of the invention is the provision of flow openings (passages) 46 in each wall 43, 44 or 45. The water level in tank 12 is designated by numeral 48. Tank 12 is located in the motion path of passenger compartment units 36, such that during rotational movement of the ferris wheel around the axle 18 axis each passenger compartment unit will move into and out of the water in the tank. Flow openings 46** in the passenger compartment walls will enable some of the displaced water to fill the compartments (at least partially). The persons seated in the compartments will be wearing bathing suits. Since the compartment units will be moving, the people in the compartments will feel as though they are directly immersed in a fast-moving stream of water.

The amount of water admitted into the compartments is determined at least partly by the number and size of flow openings 46. The impact of the floor wall 45 on the water surface (at 48) will create an upward spray or splash along the sides of the compartment, which further adds to the enjoyment of the passengers. Some of the splash water will collapse into the compartment unit 36 through the open sides of the unit; the sides can be partially closed if desired. As each compartment unit 36 leaves the pool of water in tank 12 most of the water admitted into the passenger compartments will drain down toward the people in the next compartment unit, thus adding further to the excitement of the event.

Figure 4:
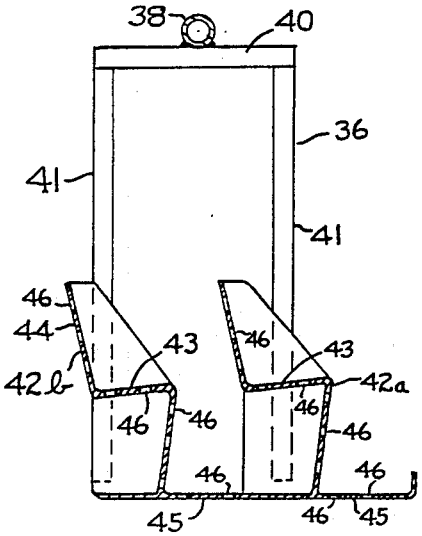
FIG. 4 is a sectional view taken through a passenger compartment unit employed in the FIG. 1 apparatus.

As shown in FIG. 4, the compartment unit 36 has a flat bottom (floor) 45. However, the bottom can be of other more streamlined shapes, conducive to achievement of desired spray patterns and water flows.

With the illustrated water level 48 in tank 12 the people in each unit 36 will be immersed to about chest level. The extent of immersion can be reduced by lowering the water level in tank 12. The extent of immersion can also be effectively varied by varying the rotational speed of the ferris wheel. At relatively low rotational speeds each compartment unit will be immersed in the pool of water for a relatively long period of time, e.g., six to ten seconds. At maximum rotational velocity the immersion time can be substantially less, e.g., only two or three seconds.

Figure 2:
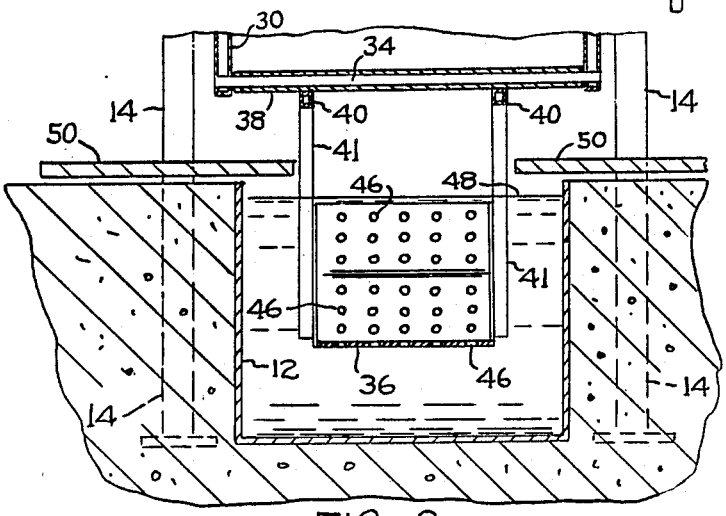
FIG. 2 is a sectional view taken on line 2–2 in FIG. 1.

Passengers are preferably loaded or unloaded at elevated points above the plane of water tank 12. FIGS. 1 and 2 show two horizontal passenger platforms 50 located along both sides of the motion plane for compartment units 36. Each platform 50 may be supported by the associated pedestal 14, such that the pedestal and platform mutually reinforce each other. As seen in FIG. 2, each platform extends inwardly beyond the associated pedestal elements so that its inner edge is in near proximity to a side surface of a passenger compartment unit 36. A passenger can step from unit 36 directly onto platform 50 (or from platform 50 directly into the compartment). Each platform 50 can extend in opposite directions from a transverse vertical plane taken through axle 18, such that each platform is able to simultaneously accommodate passengers entering (or leaving) two compartment units 36, as shown in FIG. 1. The process of loading or unloading passengers is somewhat speeded up by having platforms along both sides of the motion plane of compartment units 36. Each platform 50 may be located below axle 18 a distance slightly greater than the lengths of spokes 30, as shown in FIG. 1.

Figure 5:
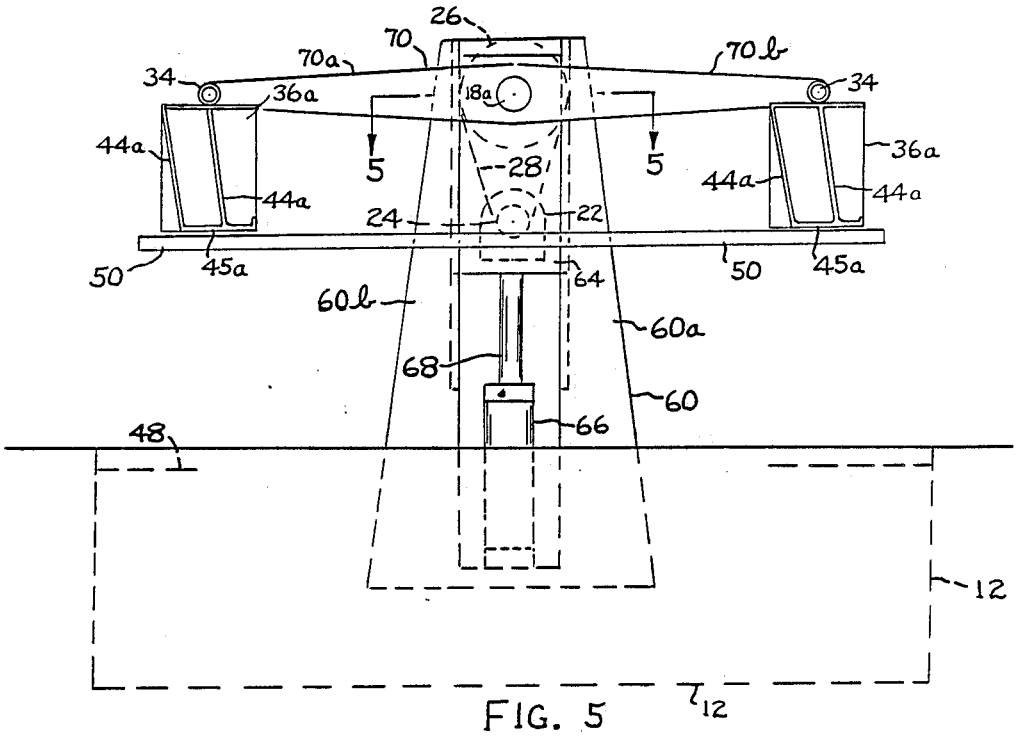
FIG. 5 is a side elevational view of another embodiment of the invention.
Figure 6:
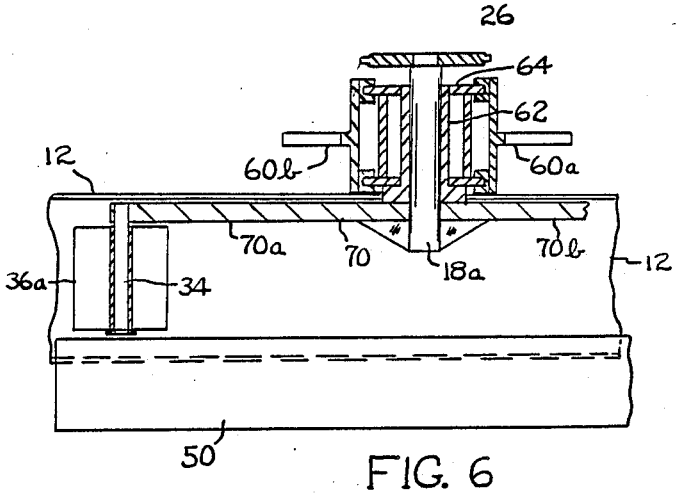
FIG. 6 is a fragmentary sectional view taken on line 5–5 in FIG. 4.

FIGS. 5 and 6 illustrate another form that the invention can take; the mechanism includes means for vertically adjusting the position of axle 18*a*, to thus vary the water immersion depth of units 36*a*. In this case there is only one pedestal structure 60 located along one side edge of water tank 12. Axle 18*a* is rotatably mounted in a sleeve 62 that extends between the vertical walls of a miniature elevator 64; elevator 64 is suitably guided for vertical motion between two upstanding pedestal members 60*a* and 60*b*. The power mechanism for moving the elevator up or down comprises a stationary fluid cylinder 66 having a piston rod 68 connected to the undersurface of elevator 64.

Axle 18*a* has one end thereof affixed to a sprocket 26. Motor 22 is mounted on (within) elevator 64 in driving relation to a sprocket 24; a chain 28 transmits a rotary drive force from sprocket 24 to sprocket 26. Axle 18*a* extends from sprocket 26 through sleeve 62 to a fixed connection with a spoke mechanism 70. The spoke mechanism forms two oppositely extending spokes 70*a* and 70*b*.

A transverse shaft 34 extends in cantilever fashion from the outer end of each spoke 70*a* or 70*b*, to form a swingable suspension mechanism for a passenger compartment unit 36*a*. Each unit 36*a* is designed to accommodate four passengers in standing attitudes. The passengers stand on a floor 45*a*, with their backs resting against an upstanding wall 44*a*. Each wall 44*a* is wide enough to accommodate two people standing alongside one another. Walls 44*a* and 45*a* have flow openings therethrough, similar to the flow openings in the walls of the passenger compartment unit 36 shown in FIG. 4.

A water tank 12 is located in the path taken by each passenger compartment unit 36*a*, such that the unit is at least partially immersed in the water in tank 12 as the unit descends into the tank. A stationary passenger platform 50 is located along only one side of the motion plane of units 36*a*.

A principal feature of interest is fluid cylinder 66. By withdrawing pressure fluid from the lower end of cylinder 66 it is possible to lower axle 18*a* toward tank 12, thereby more fully immersing the passengers in the pool of water. By pumping fluid (oil or air) into the lower end of cylinder 66 it is possible to return axle 18*a* to its original position. The axle is shown in an elevated position (for minimal immersion of the passengers).

The drawings show tank 12 embedded within the earth below the earth surface. Such a location somewhat simplifies the construction of the pedestals and passenger platforms. However, the water tank could be located above ground if so desired. Also, the pool of water could be provided by a lake or ocean in some situations, in which case the ferris wheel would be mounted on a pier or wharf.

The drawings show particular forms that the invention can take. It will be appreciated that the invention can take other forms.

What is claimed is:

1. A water immersion amusement apparatus, comprising a ferris wheel that includes an upstanding pedestal structure; a horizontal axle supported in an elevated position on the pedestal structure; a plural number of spokes radiating from said axle for rotation around the axle axis; a passenger compartment unit swingably suspended from the outer end of each spoke; at least one horizontal passenger platform located below the axle axis alongside the motion plane of the passenger compartment units; and a body of water below the passenger platform plane in the path of the passenger compartment units.

2. The apparatus of claim 1 wherein said passenger platform is located below the axle a distance slightly greater than the radial dimension of a spoke.

3. The apparatus of claim 1 wherein said passenger platform is located only a very slight distance above the surface of the water body.

4. The apparatus of claim 1 wherein there are two passenger platforms occupying spaces along both sides of the plane of motion of the passenger compartment units.

5. The apparatus of claim 4, wherein each platform extends in opposite directions from a transverse vertical plane taken through the axle axis, whereby each platform can simultaneously accommodate passengers entering or existing from two separate passenger compartment units.

6. The apparatus of claim 1, wherein each passenger compartment unit has a number of water flow passages therethrough, such that when a passenger unit passes through the body of water some of the displaced water comes into contact with the moving passengers.

7. The apparatus of claim 1, wherein each passenger compartment unit comprises at least one forwardly facing seat member, each seat member comprising a horizontal seat wall, an upstanding back rest, and a horizontal floor; said seat wall, back rest and floor having flow passages therethrough.

8. The apparatus of claim 1, and further comprising power means for vertically adjusting the position of the axle, to thus vary the water immersion depth of the passenger compartment units.

9. The apparatus of claim 8 wherein said axle adjustment means comprises a vertically oriented fluid cylinder located directly below the axle.

10. The apparatus of claim 1, wherein there is a single passenger platform located along one side of the passenger compartment unit motion plane.

11. The apparatus of claim 1, wherein each passenger compartment unit has open sides that enable water displaced by the unit to collapse through the open sides into the compartment interior space.

* * * * *